United States Patent [19]

Johnston

[11] 3,930,510

[45] Jan. 6, 1976

[54] CIGARETTE HOLDER RING

[76] Inventor: Paul R. Johnston, 110 E. 23rd Ave., North Kansas City, Mo. 64116

[22] Filed: Oct. 15, 1974

[21] Appl. No.: 514,582

[52] U.S. Cl. ..... 131/258; 63/15
[51] Int. Cl.[2] ..... A24F 13/22
[58] Field of Search ..... 131/258; 63/15

[56] References Cited

UNITED STATES PATENTS

| | | | |
|---|---|---|---|
| 1,179,025 | 4/1916 | Molinaro | 63/15 X |
| 1,289,666 | 12/1918 | Cloovas | 131/258 |
| 1,434,590 | 11/1922 | Chafetz | 131/258 |
| 1,891,431 | 12/1932 | Markart | 131/258 |
| 2,109,609 | 3/1938 | Aull | 131/258 |
| 2,134,586 | 10/1938 | Silver | 63/15 |

FOREIGN PATENTS OR APPLICATIONS

| | | | |
|---|---|---|---|
| 616,959 | 2/1961 | Italy | 131/258 |
| 118,788 | 9/1918 | United Kingdom | 63/15 |
| 322,380 | 12/1959 | United Kingdom | 131/258 |

*Primary Examiner*—Joseph S. Reich
*Attorney, Agent, or Firm*—John A. Hamilton

[57] ABSTRACT

A cigarette holder ring consisting of a resiliently contractible ring band operable to fit snugly on any portion of the wearer's finger, and a cigarette holding clip adapted normally to be folded extremely inconspicuously into the crown portion of the ring band, but to be extended therefrom to hold a cigarette, the clip being universally movably relative to the ring band to hold the cigarette in any position relative to his finger most suitable to any individual user.

3 Claims, 5 Drawing Figures

CIGARETTE HOLDER RING

Figure 1:
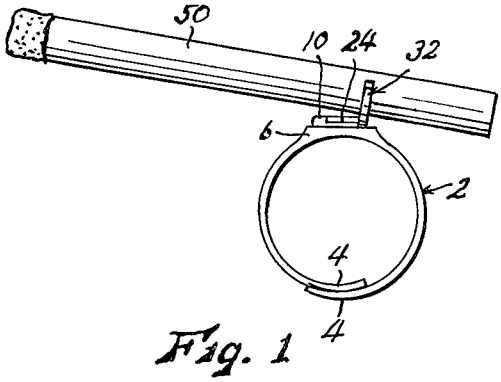

This invention relates to new and useful improvements in cigarette holders for holding cigarettes in position for smoking, and has particular reference to a cigarette holder of this class in which the actual cigarette gripping member is mounted on and forms a portion of a finger ring.

The desirability of a cigarette holder which holds the cigarette on the smoker's hand for easy and convenient accessibility while smoking, and which at the same time does not occupy the fingers nor require conscious use thereof to hold the cigarette, is readily apparent. Many persons of course smoke while engaged in other occupations, laying the cigarette down momentarily on any available surface or support while their hands must be otherwise occupied, and sometimes never retrieving the cigarette if the other occupation diverts their attention for too long a time. Not only does this practice represent a danger of burn marring or damage to the support or surface on which they lay the cigarette, but also represents a fire hazard. Also, the practice of laying down and retrieving cigarettes while smoking reduces the efficiency of the smoker in performing other jobs.

The general idea of mounting a cigarette holder on a finger ring, whereby to secure the cigarette to the finger in a position convenient for smoking, while at the same time leaving the hand and fingers free for performing other functions, is not in itself new. However, all cigarette holder rings within my knowledge have been subject to certain disadvantages and shortcomings. For example, most have been capable of holding a cigarette in substantially only one position relative to the ring itself, and this single position might very well not be comfortable or convenient to a given individual smoker. Also, in most prior devices of this type the ring is necessarily worn at or adjacent the base of the finger, which also disposes the cigarette in a rather artificial position which may not be convenient or comfortable for some smokers. Also, in most prior devices of this type the actual cigarette holding clip or other cigarette gripping member has usually constituted a permanent and fixed projection from the ring band, which renders the ring completely unsuitable for general or continuous wear, and necessitates that it be retrieved from a pocket or other keeping place and placed on the finger whenever its use is desired. This necessity does much to reduce the utility which is the original object of such a ring.

Accordingly, the object of the present invention is the provision of a cigarette holder ring which largely obviates the above enumerated disadvantages and shortcomings of prior devices, in that it can hold the cigarette in virtually any desired attitude relative to the ring band itself, in that the ring band can be worn on any portion of a finger, usually the forefinger, from the base to the tip thereof, and in that it is well adapted for continuous wear even when the wearer is not smoking. Generally, these characteristics are obtained by the provision of a ring including a finger band which is resiliently expandable and contractible to fit snugly on any portion of a finger from its base to its tip, and having a crown portion including a cigarette holding clip, the clip normally being foldable into the crown member so as to conform closely to the contour thereof, but being extendable to a use position, and being substantially universally adjustable relative to the band to adjust the position of the cigarette relative to the band.

Other objects are simplicity and economy of construction, efficiency, dependability and convenience of operation, and adaptability for production either as a low-priced strictly utilitarian item, or as a highly attractive item of fine jewelry.

Figure 4:
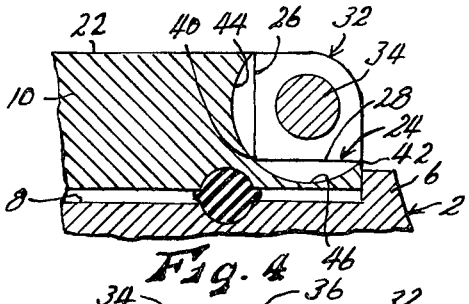
Figure 5:
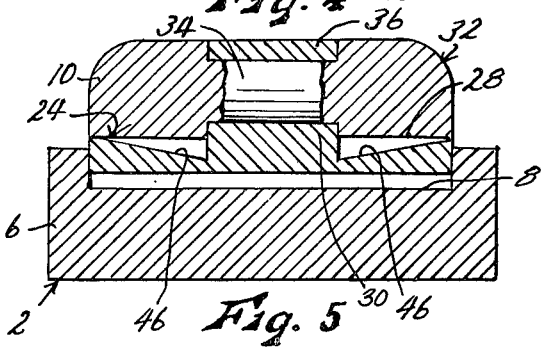
Figure 2:
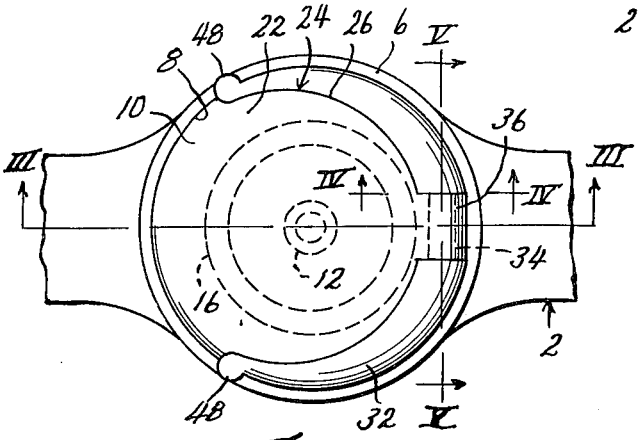
Figure 3:
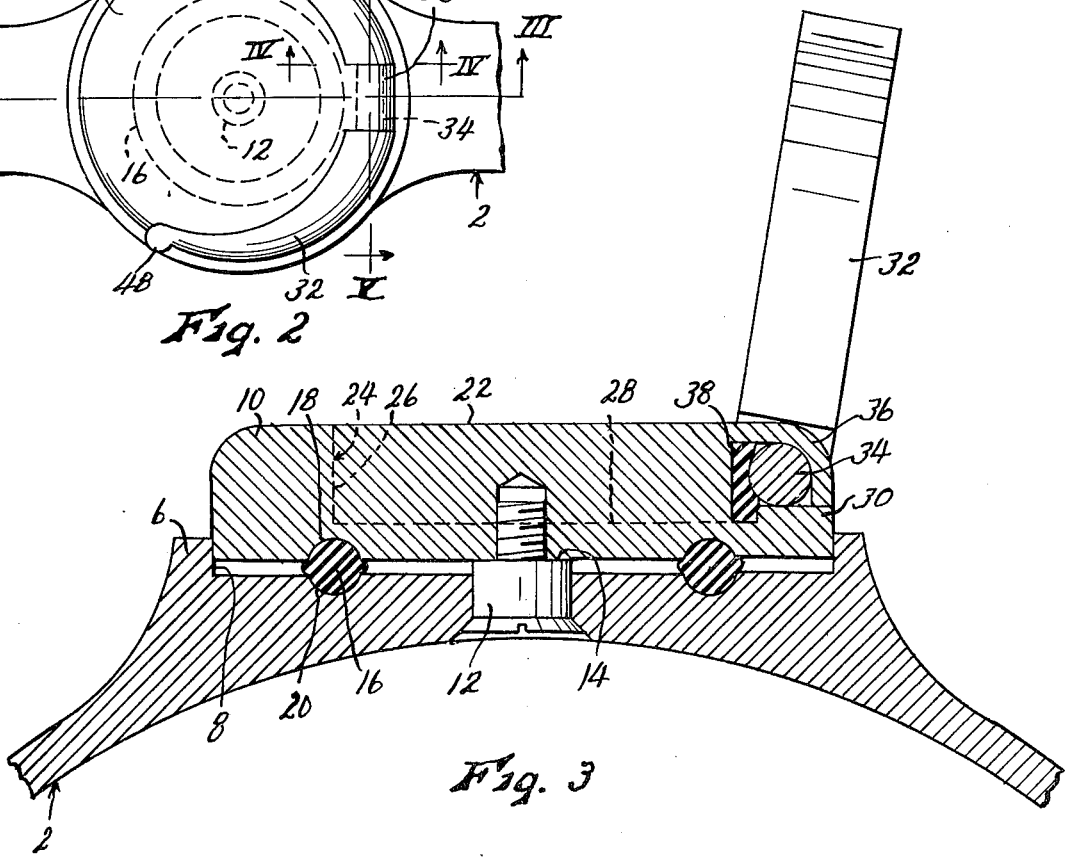

With these objects in view, as well as other objects which will appear in the course of the specification, reference will be had to the accompanying drawing, wherein:

FIG. 1 is a side elevational view of a cigarette holder ring embodying the present invention, showing a cigarette operatively mounted therein, FIG. 2 is an enlarged, fragmentary top plan view of the crown portion of the ring, showing the cigarette holder clip folded in its non-use position, FIG. 3 is an enlarged, fragmentary sectional view taken on line III—III of FIG. 2, showing the clip extended to a use position, FIG. 4 is an enlarged, fragmentary sectional view taken on line IV—IV of FIG. 2, and FIG. 5 is an enlarged sectional view taken on line V—V of FIG. 2 left partially in elevation.

Like reference numerals apply to similar parts throughout the several views, and the numeral 2 applies generally to the band of the ring, constituting an elongated strip formed in a circular configuration, with its end portions 4 disposed in overlapping relation as shown in FIG. 1. Said band is formed of a material, preferably metal, which in the radially thin section thereof constituting the major portion of its length is resiliently expandable and contractible. Therefore it can be applied to any portion of the wearer's finger from the base to the tip thereof, and will fit snugly at any such point. The overlapping of its end portions 4 prevents pinching of the wearer's skin.

Generally midway of the length of band 2, said band is both radially thickened and transversely widened to form a post portion 6, this post being rendered substantially rigid by its greater bulk as compared to the rest of the band. This post portion is of course adapted to be worn at the outside of the wearer's finger, and as best shown in FIG. 2 is generally circular about an axis radial to band 2 and to the wearer's finger. Formed in the outer surface of said post, concentric with the same axis, is a shallow cylindrical socket 8, and a flat, disc-like crown member 10 is mounted rotatably in said socket, concentrically therewith. Said crown member is secured in socket 8 by a screw 12 inserted outwardly through post 6 at the axis thereof said screw being rotatable in the post and threaded into the crown. A shoulder 14 of said screw holds the inner surface of the crown in spaced relation from the base of socket. A rubber O-ring 16 is interposed between the crown and socket, concentrically with screw 12, said O-ring being contained in circular grooves 18 and 20 formed respectively in these members, and being resiliently compressed as screw 12 is tightened, whereby to supply friction yieldably resisting rotation of the crown in the socket.

The thickness of crown 10 is substantially greater than the depth of socket 8, so as to project outwardly from said socket. The outer end surface 22 of said crown is substantially planar, and may be decoratively engraved if desired, or a suitable gem stone set therein. These are matters of decoration, not function, and are not shown.

A groove 24 is formed in the outer periphery of crown 10, extending around somewhat more than half the periphery thereof. Said groove opens both through to top surface 22 of the crown, and also through the cylindrical surface of the portion of said crown extending outwardly from socket 8. Said groove thus has a generally cylindrical surface 26 of greater than semi-circular extent, and a generally planar surface 28 normal to the crown axis. Surface 28 is planar except that at its mid-point, it is slightly raised to provide a pillow block 30 (see Fig. 3). Also, surface 28 is of somewhat greater radial width at its midpoint than at its ends, thereby imparting to said surface a crescent shape in its own plane.

Normally disposed within groove 24 is a cigarette holding clip 32 of greater than semi-circular extent, and which is crescent-shaped in its own plane coinciding with the general contour of surface 28 of groove 24, and of the same thickness, transversely of its plane, as the width of surface 26 of said groove. At its central portion, it is reduced to form a short cylindrical axle 34. Said axle rests on pillow block 30 as best shown in FIG. 3, and is secured in place by a tab 36 of crown 10 which initially projects radially outwardly from said crown at a spacing from pillow block 30 equal to the diameter of axle 34, but which is then bent downwardly at right angles around said axle to engage pillow block 30 smoothly, also as shown in FIG. 3, after said axle has been properly positioned. Tab 36, as it is bent into place, presses axle 34 into compressing engagement with a rubber block 38 disposed between said axle and the corresponding portion of wall 26 of groove 24, whereby to provide frictional resistance to pivotal movement of the clip by the turning of axle 34 within said clip. Rubber block 38 may be longitudinally coextensive with the axle. It will be seen in FIG. 4 that adjacent each end of axle 34, the cross-sectional contour of the clip is generally square, therefore presenting corners 40 and 42 which would interfere with surfaces 26 and 28 respectively of groove 24 and would prevent pivoting of the clip from the folded position of FIGS. 2, 4 and 5 to the extended position of FIGS. 1 and 3. To prevent this interference, groove surface 26 is relieved as shown at 44 in FIG. 4, and surface 28 is relieved as shown at 46 in FIGS. 4 and 5, to provide operating clearance. The relief is provided by grooving these surfaces, and these grooves need extend angularly of the crown from the axle only far enough to prevent the described interference. They do not open through any external surface of the crown. Thus when the clip 32 is folded into groove 24 as in FIGS. 2 4 and 5, the external configuration of the extended portion of crown 10 is completed by the clip, which fills groove 24, so as to appear substantially undisturbed and the clip scarcely noticable. The clip may be provided at each end thereof with a rounded outward protuberance 48 (see FIG. 2) if desired, as an aid in grasping and pivoting the clip to an extended use position as shown in FIGS. 1 and 3, but they are not necessary if still better outward appearance is desired. The clip is held releasably in this folded position by the frictional resistance of rubber block 38.

When it is desired to use the device as a cigarette holder, the wearer simply grasps the clip, at protuberances 48 or elsewhere, and pivots it outwardly from the crown to an extended position such as in FIGS. 1 and 3, and presses a cigarette 50 into said clip as shown in FIG. 1. The internal diameter of the clip is slightly smaller than the generally standardized diameter of a cigarette, so that the cigarette is slightly compressed as it is inserted. The cigarette itself has a certain degree of resilience, so that the clip itself need not be appreciably yieldable. The clip may be pivoted outwardly to any desired degree, and will be retained at any setting by friction block 38, so that the cigarette may be disposed at any desired angle about an axis parallel to the user's finger, according to the preferences of each individual user. Usually the clip should be pivoted outwardly at least somewhat more than 90°, as shown, in order that if the cigarette should be smoked down quite close to the clip, the heat therefrom will be less likely to damage or mar the outer surface of the crown. Also, by grasping the extended clip, the entire crown can be turned as desired about the axis of screw 12, and will be held releasably at any such setting by friction provided by O-ring 16. Thus the cigarette may be disposed at any desired angle about an axis generally radial to the wearer's finger, also as dictated by the wearer's inclinations and preferences. Thus, axle 34 and screw 12 provide a generally universal adjustment of the cigarette relative to the wearer's finger. This provision, in conjunction with the previously described fact that the ring can be moved to and worn on any portion of the finger from its base to its tip, clearly provides for maximum flexibility and convenience in positioning the cigarette in any attitude the smoker may desire, or which might be dictated by such other activity in which he may be engaged.

While I have shown and described a specific embodiment of my invention, it will be readily apparent that many minor changes of structure and operation could be made without departing from the spirit of the invention.

What I claim as new and desire to protect by Letters Patent is:

1. A cigarette holder finger ring comprising:

a. ring-shaped band portion adapted to encircle the finger of a wearer, b. a crown member attached to said band portion by means permitting rotation of said crown member relative to said band portion about an axis generally radial to said band portion, and having a generally planar outer surface generally parallel to the axis of said band, and c. a clip of generally planar shape pivotally connected to said crown member for movement between a folded position in which its plane is generally parallel to the axis of said band and it lies against the outer surface of said crown member, and an extended position in which its plane extends outwardly from said crown member, said clip being adapted to receive and hold a cigarette therein when in its extended position.

2. The device as recited in claim 1 with the addition of means frictionally resisting rotation of said crown member relative to said band portion.

3. The device as recited in claim 2 with the addition of means frictionally resisting pivotal movement of said clip relative to said crown member.

* * * * *